US011905613B2

(12) United States Patent
Dal Zilio et al.

(10) Patent No.: US 11,905,613 B2
(45) **Date of Patent: *Feb. 20, 2024**

(54) ELECTROPLATING BATH CONTAINING TRIVALENT CHROMIUM AND PROCESS FOR DEPOSITING CHROMIUM

(71) Applicant: COVENTYA S.P.A., Carugo (IT)

(72) Inventors: Diego Dal Zilio, Quinto di Treviso (IT); Gianluigi Schiavon, Mogliano Veneto (IT)

(73) Assignee: Coventya S.p.a., Carugo (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/808,948

(22) Filed: Mar. 4, 2020

(65) Prior Publication Data

US 2020/0308723 A1 Oct. 1, 2020

Related U.S. Application Data

(63) Continuation of application No. 15/113,682, filed as application No. PCT/EP2015/051469 on Jan. 26, 2015, now Pat. No. 10,619,258.

(30) Foreign Application Priority Data

Jan. 24, 2014 (EP) ..... 14152463

(51) Int. Cl.
*C25D 3/06* (2006.01)
*C25D 3/10* (2006.01)
(Continued)

(52) U.S. Cl.
CPC ..... *C25D 3/06* (2013.01); *C25D 3/10* (2013.01); *C25D 17/002* (2013.01)

(58) Field of Classification Search
CPC ... C25D 3/06; C25D 3/10; C25D 3/56; C25D 5/00; C25D 5/18
(Continued)

(56) References Cited

U.S. PATENT DOCUMENTS 3,006,823 A * 10/1961 Deyrup ..... C25D 3/10 205/290
4,062,737 A * 12/1977 Barclay ..... C25D 3/06 204/252
(Continued)

FOREIGN PATENT DOCUMENTS

CN 101512047 A 8/2009
CN 101565827 A 10/2009
(Continued)

OTHER PUBLICATIONS

Mexican Patent Office, Office Action in Mexican Patent Application No. MX/a/2016/009533 (dated Jul. 15, 2020).
(Continued)

*Primary Examiner* — Edna Wong
(74) *Attorney, Agent, or Firm* — Carmody Torrance Sandak & Hennessey LLP

(57) ABSTRACT

The present invention refers to an electroplating bath for depositing chromium which comprises at least one trivalent chromium salt, at least one complexing agent, at least one halogen salt and optionally further additives. Moreover, the invention refers to a process for depositing chromium on a substrate using the mentioned electroplating bath.

21 Claims, 2 Drawing Sheets

(51) Int. Cl.

| | |
|---|---|
| ***C25D 3/56*** | (2006.01) |
| ***C25D 5/00*** | (2006.01) |
| ***C25D 5/18*** | (2006.01) |
| ***C25D 17/00*** | (2006.01) |

(58) Field of Classification Search
USPC ..... 205/243, 286, 287, 289, 290, 108
See application file for complete search history.

(56) References Cited

U.S. PATENT DOCUMENTS

| | | | | | |
|---|---|---|---|---|---|
| 4,093,521 | A | * | 6/1978 | Renton | C25D 3/06 205/243 |
| 4,107,004 | A | | 8/1978 | Ward et al. | |
| 4,142,948 | A | * | 3/1979 | Tajima | C25D 3/06 205/243 |
| 4,169,022 | A | | 9/1979 | Ward et al. | |
| 4,392,922 | A | | 7/1983 | Tomaszewski | |
| 4,466,865 | A | | 8/1984 | Tomaszewski et al. | |
| 4,477,318 | A | * | 10/1984 | Tomaszewski | C25D 21/18 205/101 |
| 4,804,446 | A | * | 2/1989 | Lashmore | C25D 3/06 205/104 |
| 5,196,109 | A | * | 3/1993 | Scott | C25D 3/06 205/290 |
| 5,415,763 | A | * | 5/1995 | Johnson | C25D 3/06 205/287 |
| 6,004,448 | A | | 12/1999 | Martyak | |
| 6,663,700 | B1 | | 12/2003 | Matzdorf et al. | |
| 10,619,258 | B2 | * | 4/2020 | Dal Zilio | C25D 17/002 |
| 2007/0227895 | A1 | * | 10/2007 | Bishop | C25D 3/10 205/287 |
| 2008/0169199 | A1 | * | 7/2008 | Huang | C25D 5/34 205/210 |
| 2008/0223726 | A1 | * | 9/2008 | Eckles | C08G 73/02 205/305 |
| 2009/0114544 | A1 | * | 5/2009 | Rousseau | C25D 3/10 205/243 |
| 2013/0213813 | A1 | | 8/2013 | Hingley et al. | |
| 2013/0220819 | A1 | | 8/2013 | Hall et al. | |
| 2017/0009361 | A1 | | 1/2017 | Dal Ziliio et al. | |
| 2018/0245227 | A1 | | 8/2018 | Abbott et al. | |

FOREIGN PATENT DOCUMENTS

| | | | | | |
|---|---|---|---|---|---|
| CN | 101665960 | A | | 3/2010 | |
| CN | 101748449 | A | | 6/2010 | |
| CN | 102383150 | A | * | 3/2012 | C25D 3/06 |
| CN | 103993303 | A | | 8/2014 | |
| EP | 1 702 090 | A1 | | 9/2006 | |
| EP | 2 492 372 | A1 | | 8/2012 | |
| GB | 1488381 | A | * | 10/1977 | C25D 3/06 |
| GB | 2024863 | A | * | 1/1980 | C25D 3/06 |
| GB | 2086939 | A | * | 5/1982 | C25D 21/18 |
| KR | 100572486 | B1 | * | 4/2006 | C25D 3/06 |
| WO | WO 2005/073438 | A1 | | 8/2005 | |
| WO | WO 2008/014987 | A2 | | 2/2008 | |
| WO | WO 2009/046181 | A1 | | 4/2009 | |

OTHER PUBLICATIONS

Reply to Office Action in Mexican Patent Application No. MX/a/2016/009533 (dated Dec. 10, 2020).

Chandrasekar et al., "Pulse and pulse reverse plating—Conceptual, advantages and applications," *Electrochimica Acta* 53: 3313-3322 (2008).

Protsenko et al., "Improving hardness and tribological characteristics of nanocrystalline Cr—C films obtained from Cr(III) plating bath using pulsed electrodeposition," *Int. Journal of Refractory Metals and Hard Materials* 31: 281-283 (2012).

European Patent Office, International Search Report in International Application No. PCT/EP2015/051469 (dated Apr. 23, 2015).

European Patent Office, Written Opinion in International Application No. PCT/EP2015/051469 (dated Apr. 23, 2015).

International Bureau of WIPO, International Preliminary Report on Patentability in International Application No. PCT/EP2015/051469 (dated Jul. 26, 2016).

State Intellectual Property Office of the People's Republic of China, First Office Action in Chinese Patent Application No. 2015800043847 (dated May 4, 2017).

State Intellectual Property Office of the People's Republic of China, Second Office Action in Chinese Patent Application No. 2015800043847 (dated Jan. 3, 2018).

* cited by examiner

ELECTROPLATING BATH CONTAINING TRIVALENT CHROMIUM AND PROCESS FOR DEPOSITING CHROMIUM

CROSS-REFERENCE TO RELATED APPLICATIONS

This patent application is a continuation of U.S. patent application Ser. No. 15/113,682, filed on Jul. 22, 2016, now U.S. Pat. No. 10,619,258, which is the U.S. national phase of International Application No. PCT/EP2015/051469, filed on Jan. 26, 2015, which claims the benefit of European Patent Application No. 14152463.7, filed Jan. 24, 2014, the disclosures of which are incorporated herein by reference in their entireties for all purposes.

The present invention refers to an electroplating bath for depositing chromium which comprises at least one trivalent chromium salt, at least one complexing agent, at least one halogen salt and optionally further additives. Moreover, the invention refers to a process for depositing chromium on a substrate using the mentioned electroplating bath.

Chromium plating from trivalent chrome plating baths has been known for years and many documents in the prior art mention the ability to obtain chrome deposits from a trivalent chrome bath.

It is now very well established that uniform coatings of chromium of a thickness between 0.1 and 1 μm can be produced from trivalent chrome electrolytes. These thicknesses are well suited for the so called decorative applications.

However, there are many applications where thicker chromium layers are required, i.e. applications for high wear and/or corrosion resistance, like the plating of chrome on sanitary fittings, on exterior automotive parts, but also functional applications for plating on rods, pistons or landing gear components. The required thicknesses for these applications are between 0.1 and 300 μm.

U.S. Pat. No. 4,804,446 describes a process for electrodepositing hard smooth coatings of chromium. The bath includes chromium(III) chloride as a source of chromium, citric acid to complex the chromium, and a wetting agent preferably Triton X 100. Bromide is also added to prevent production of hexavalent chromium at the anode. The pH of the bath is maintained at 4.0 and the temperature at approximately 35° C. Moreover, the electrolyte further comprises boric acid to advance the reaction kinetics. However, due to the toxic and hazardous potential of boric acid it would be desirable to avoid its presence in the electroplating bath.

WO 2009/046181 discloses deposits of nanogranular crystalline or amorphous functional chromium alloys obtained from a trivalent chromium bath containing a carboxylic acid and comprising sources for divalent sulfur and of carbon, nitrogen and oxygen which are the alloying components. The deposits contain from 0.05 to 20 wt % of sulfur, and the electrodeposition baths used to plate these deposits contain the source(s) of divalent sulfur in a concentration range from about 0.0001 M and 0.05 M.

US2013/0220819 describes a process for producing a dense hard chrome coating from a trivalent chromium plating bath. The coatings have microhardness values between 804 KHN up to 1067 KHN. These properties are achieved by using a trivalent chromium electrolyte and a pulsed plating with a waveform of dedicated cycles. It has to be noted that the use of pulse current for electroplating hard chrome on complex and large surface parts requires some major modifications of the plating equipment. However, it would be desirable not to use a pulsed current to deposit the mentioned thick chrome layers.

Several publications describe the use and the effects of the pulse and pulse reverse current on the trivalent chromium process for the hard chrome application.

The publication "Pulse and pulse reverse plating—Conceptual, advantages and applications," M. S. Chandrasekar, Malathy Pushpavanam Central Electrochemical Research Institute, Karaikudi 630006, TN, India *Electrochimica Acta* 53 (2008) 3313-3322 is a review on pulse and pulse reverse techniques for electrodeposition wherein the pulse electrodeposition (PED) of some metals and alloys is reported. The effects of mass transport, electrical double layer pulse parameters and current distribution on the surface roughness and on the morphology are presented. Applications, advantages and disadvantages of PC and PRC techniques are discussed along with theoretical aspects and mechanism.

In "Improving hardness and tribological characteristics of nanocrystalline Cr—C films obtained from Cr(III) plating bath using pulsed electrodeposition," *Int. Journal of Refractory Metals and Hard Materials* 31 (2012) 281-283 the effect of pulsed electrodeposition on the nanocrystal size, composition, hardness, coefficient of friction, and wear resistance was investigated for the Cr—C electrodeposits obtained from a trivalent chromium bath. The electrodeposits were shown to contain about 9% of carbon. Pulsed electrodeposition does not significantly affect the carbon content. At the same time, an increase in the off-time duration leads to a decrease in the nanocrystals size. The hardness and wear parameters of the electrodeposits may be sufficiently improved when using pulsed current. For instance, at $t_{on}=t_{off}=1$ s, the hardness reaches the values of ~1200÷1300 HV (while it is close to 850÷950 HV at a steady-state electrolysis).

Though there are several publications about trivalent chrome deposition there is still a need for a commercial system which allows to plate consistent thick chrome deposits of thicknesses between 0.1 and 300 μm, with are dense and uniform, and show corrosion resistance, hardness and wear properties equivalent to a deposit made out of a $CrO_3$ based electrolyte.

It was therefore an object of the present invention to provide an electroplating bath which provides chromium layers with a dense and uniform structure of a thickness which makes the layers usable for high wear and/or corrosion resistance.

BRIEF SUMMARY OF THE INVENTION

This object has been solved by the features of the electroplating bath and the process for depositing chromium layers described herein.

According to the present invention an electroplating bath for depositing chromium is provided which comprises:

a) 100 to 400 g/L of at least one trivalent chrome salt
b) 100 to 400 g/L of at least one complexing agent,
c) 1 to 50 g/l of at least one halogen salt
d) 0 to 10 g/L of additives.

Moreover, the electroplating bath has a pH from 4 to 7. It is essential for the present invention that the electroplating bath is substantially free of divalent sulphur compounds and boric acid and/or its salts and derivatives.

It was surprisingly found that with the inventive electroplating bath layers with a dense and uniform structure can be provided. As the layers are provided with thickness of 10 to 400 μm the layers can be used for high wear and/or corrosion resistance applications.

The trivalent chromium salt is preferably selected from the group consisting of chromium(III) sulphate, in acidic or alkaline form, chromium(III)chloride, chromium(III) acetate, chromium(III) hydroxyacetate, chromium(III) formate, chromium(III) hydroxy formate, chromium(III) carbonate, chromium(III) methanesulfonate, potassium chromium(III) sulphate, and mixtures thereof.

It is preferred that the trivalent chromium salt is present in an amount of 100 to 400 g/L, in particular in an amount of 120 to 160 g/L.

A major drawback associated with the electrolytes described in the prior art refers to the accumulation of the counterion of the trivalent chromium salt. The consumption of Cr(III) in such baths can be very high, in particular if the targeted thicknesses are in the upper range >10 μm. The counterion associated with the trivalent chromium cation will then accumulate in the electrolyte and create some drawbacks like increase of the bath density and risks of precipitation. The dry content of the bath can increase up to a point where further dissolution of trivalent chromium salts is impossible due to the solubility limit.

It is therefore one preferred embodiment of the present invention to select a counterion for the trivalent chromium salt contains a "temporary", i.e. electrolytically consumable anion which will not accumulate in the electrolyte to the same extent as "permanent" anions (like sulphate). Among these temporary anions, formate, acetate, propionates, glycolates, oxalates, carbonate, citrates, and combinations thereof are preferred.

The inventive electroplating bath preferably comprises an alloy former selected from the group consisting of vanadium, manganese, iron, cobalt, nickel, molybdenum, tungsten, and indium. The organic components of the bath and ammonia are sources for carbon, nitrogen and oxygen taken up by the alloy during its deposition. Urea as an additive is also particularly efficient. Preferably, the electroplating bath comprises ammonia, especially in a molar concentration which is less than or equal to the molar concentration of the at least one complexing agent. Most preferably, ammonia is comprised in a concentration of 70 g/L to 110 g/L The presence of salts of metals not co-deposited in the alloy, like aluminium and/or gallium, is also advantageous owing to the formation of mixed-metal complexes with chromium(III) in the bath influencing the kinetics and mechanism of the deposition. However, the electroplating bath may also be free of said salts of metals (e.g., free of aluminium salts).

According to the present invention, the complexing agent is preferably selected from the group consisting of carboxylic acids and carboxylate salts, preferably formic acid, acetic acid, propionic acid, glycolic acid, lactic acid, oxalic acid, malic acid, citric acid, tartaric acid, succinic acid, gluconic acid, glycine, aspartic acid, glutamic acid, and mixtures thereof, or their salts and mixtures thereof.

The complexing agent is preferably present in an amount of 100 to 300 g/L, more preferably 150 to 250 g/L. The molar ratio of the complexing agent to the trivalent chromium salt is from 8:1 to 15:1, preferably 10:1 to 13:1 which allows the operation of the bath in the mentioned pH range and ensures deposition of chromium and not chromite.

The halogen salt present in the electroplating bath acts as a suppressor for the generation of hexavalent chromium in the bath. The halogen salt is preferably selected from the group consisting of bromide, chloride, iodide, fluoride salts and mixtures thereof. The bromide salts are more preferred, in particular potassium bromide, sodium bromide, ammonium bromide and mixtures thereof. The halogen salt is preferably present in an amount of 5 to 50 g/L.

The additives of the electroplating bath may be selected from the group consisting of brighteners, such as a polyamine or a mixture of polyamines including quaternary ammonium compounds (which are the preferred brightening agents for the application like the ones cited in U.S. Pat. No. 7,964,083) and wetting agents like electroneutral, cationic and amphoteric surfactants.

It is particularly preferred that the electroplating bath is (substantially) free of chloride ions and/or (substantially) free of aluminium ions, but the bath may contain fluoride which—as at least one further complexing agent (ligand) and/or as at least one further halogen salt—assists in the ligand exchange of the chromium(III) complexes in the bath.

According to the invention also a process for depositing chromium on a substrate is provided including the following steps:

providing the above-described electroplating bath,
immersing a substrate in the electroplating bath and
applying an electrical current to deposit the chromium on the substrate.

The temperature during deposition is preferably from 20 to 60° C., more preferably from 30 to 50° C.

The electroplating bath can be separated from the anode by a membrane, preferably by an anionic or cationic exchange membrane or a porous membrane, more preferably by a cationic exchange membrane. A cationic exchange membrane has the advantage that the migration of sulphate in the catholyte is prevented.

The anodes used to perform the deposit will be made of an insoluble material like graphite or mixed oxides materials like titanium covered with oxides of Tantalum and Iridium.

In one specific embodiment of the invention, the anodes can be surrounded by an appropriate material defining an anolyte and a catholyte to prevent certain components of the electroplating bath from coming into contact with the anode and to keep undesirable oxidation breakdown products in confinement.

Undesirable species are for example Cr(VI) originating from the anodic oxidation of Cr(III), but also the products of the oxidation of the complexing agents at the anode.

Another benefit linked to the use of a barrier material to isolate the anodic region from the bath is to avoid the accumulation of species that are not electrodeposited and will accumulate in the catholyte like sulfate, for example upon replenishment with chromium(III) sulfate.

The barriers can be any material selected from the class of ion exchange membranes. They can be anionic exchange membranes, e.g., the Sybron IONAC material MA 3470. Also cationic exchange membranes can be used, e.g., Nafion membranes from (Du Pont). One preferred cationic exchange membrane is the N424 membrane. Moreover, porous membranes, e.g., as described in EP 1 702 090, can also be considered as appropriate materials to define an anodic compartment separated from the remainder of the electrolyte.

The anodic compartment can be filled with any conducting substance compatible with the electrolyte. It can be acidic or alkaline. Due to the slight acidic pH of the parent catholyte, an acidic pH will also be preferred for the anolyte. Formic acid, acetic acid, propionic acid, glycolic acid, citric acid but also mineral acids like $H_2SO_4$, $H_3PO_4$ can be employed. A liquid solution of chromium (III) sulfate can also be used as the anolyte. Alternatively, sodium hydroxide, potassium hydroxide, lithium hydroxide or any kind of alkaline solution free of CMR properties can be used as anolyte in the process of the invention.

The current applied in the electrolyte can be a direct current or alternatively a pulsed current. The use of a pulsed current sequence provides the ability to plate deposits that are less sensitive to the formation of cracks due to hydrogen accumulation at the interface.

The pulsed sequence can be composed of a cathodic phase followed by a T off to help for the removal of hydrogen from the interface or eventually an anodic phase can be imposed to oxidize hydrogen at the interface.

BRIEF DESCRIPTION OF THE SEVERAL VIEWS OF THE DRAWINGS

The present invention is further illustrated by the following Figures and Examples. However, the present invention is not limited to these specific embodiments.

DETAILED DESCRIPTION OF THE INVENTION

Figure 1:
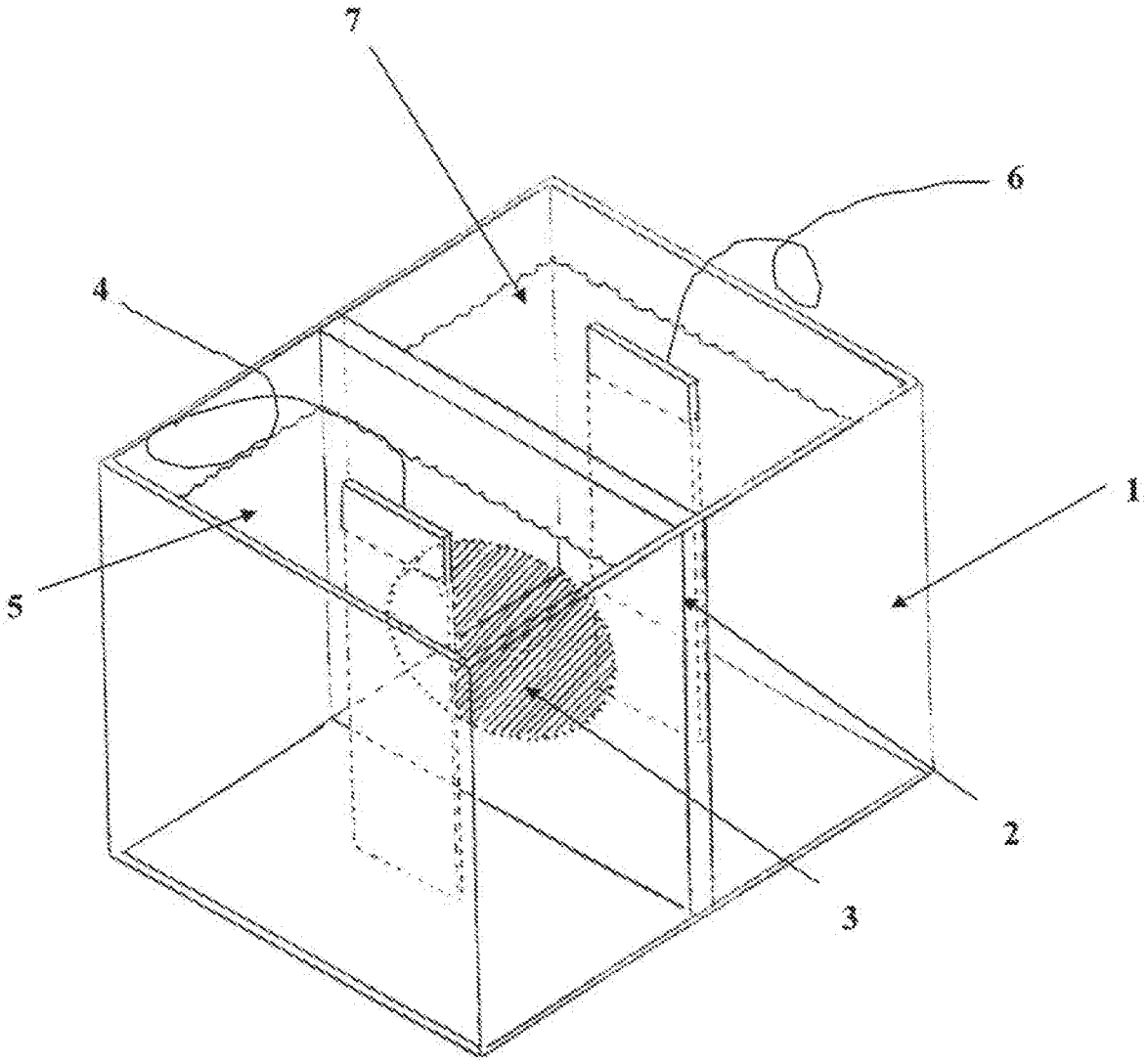
FIG. 1 shows a schematic illustration of the anodic setup according to one embodiment of the present invention.

The inventive embodiment 1 illustrated in FIG. 1 uses an anolyte 7 that can serve as a reservoir of Cr(III) ions. A solution of a trivalent chromium salt such as chromium sulphate or any other chromium salt comprising 10-50 g/L of trivalent chromium and 30-140 g/L of sulfate anions or other anions is used as a component of the anolyte 7 in the FIG. 1. The ion exchange membrane 3 may be included in or bound to a carrier 2 and will preferably be selected as a cation exchange membrane like Nafion N424 mentioned above. The catholyte 5 is composed of the trivalent chrome electrolyte of the invention as described in the following Example 2. The anode 6 is made of graphite material. A sample part to be plated is placed as cathode 4. The replenishment of chromium salt in the form of chromium (III) sulphate is carried out in the anolyte.

Figure 2:
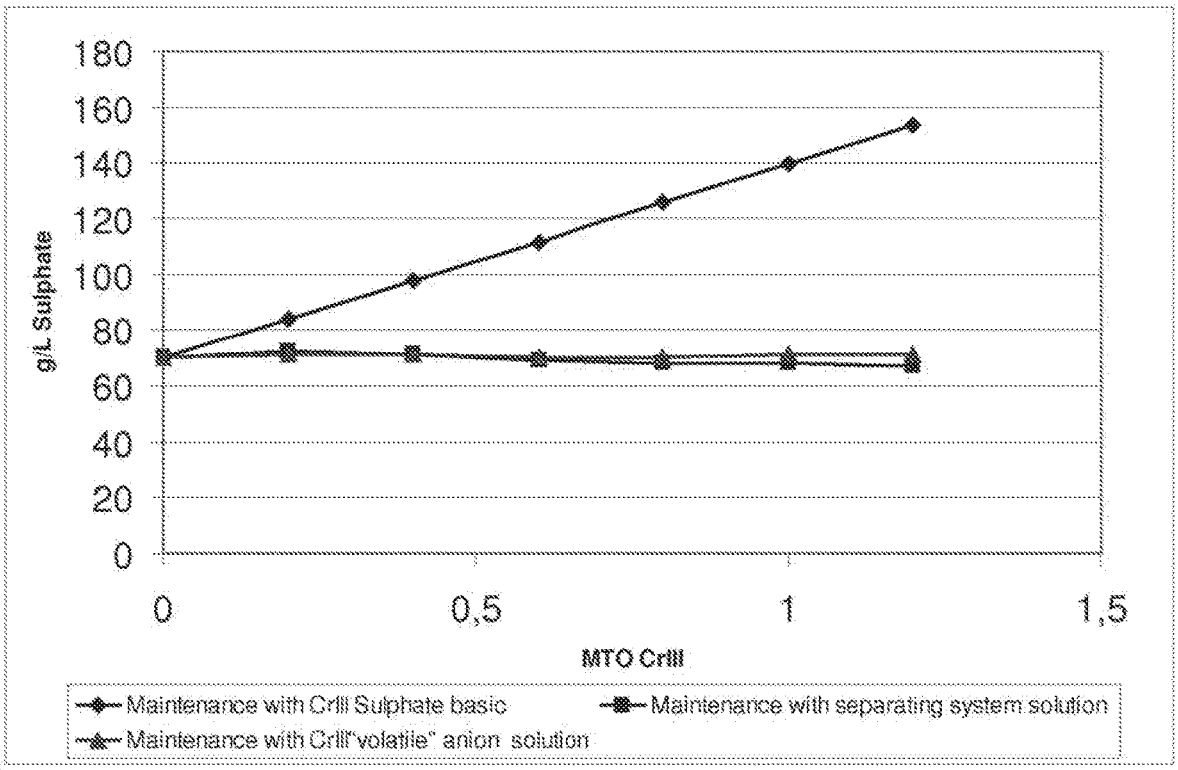
FIG. 2 shows a diagram illustrating the development of the sulphate concentration for different electroplating systems

In FIG. 2, the diagram demonstrates the time-dependence of the sulphate concentration in different electroplating systems. While the sulphate concentration for the electroplating system based on a bath with Cr(III) sulphate and without a membrane rapidly increases, the concentrations for the first embodiment according to the present invention using a "temporary" anion and for the second embodiment according to the present invention using a membrane separation stay substantially constant for the measurement period.

In Table 1 shows the compositions of the electroplating baths of the inventive Examples 1-4 and of a reference example based on Cr(VI) together with the operation parameters for each electroplating bath.

TABLE 1

| | Reference Example | Example 1 | Example 2 | Example 3 | Example 4 |
|---|---|---|---|---|---|
| $CrO_3$ | 300 g/L | | | | |
| $H_2SO_4$ | 3.5 g/L | | | | |
| Organic Catalyst | 50 mL/L | | | | |
| Chromium Sulphate basic | | 140 g/l (0.46M) | 140 g/l (0.46M) | 140 g/l (0.46M) | 140 g/l (0.46M) |
| Formic Acid | | 250 g/L (5.43M) | 250 g/L (5.43M) | 250 g/L (5.43M) | 250 g/L (5.43M) |
| $NH_3$ | | 90 g/L (5.3M) | 90 g/L (5.3M) | 90 g/L (5.3M) | 90 g/L (5.3M) |
| KBr | | 10 g/L (0.085M) | 10 g/L (0.085M) | 10 g/L (0.085M) | 10 g/L (0.085M) |
| PEG 400 | | 0.5 g/L | 0.5 g/L | 0.5 g/L | 0.5 g/L |
| Quaternary ammonium compound | | 1 g/L | 1 g/L | 1 g/L | 1 g/L |
| Operating parameters | | | | | |
| Temperature | 50° C. | 35-45° C. | 35-45° C. | 35-45° C. | 35-45° C. |
| Current density | 50 A/dm2 DC | 50 A/dm2 DC | 50 A/dm2 PRC | | |
| pH | — | 5-5.5 | 5-5.5 | 5-5.5 | 5-5.5 |
| Cathodic duty cycle | | | 96% | 96% | 96% |
| Frequency | | | 6.5 Hz | 6.5 Hz | 6.5 Hz |
| Magnetic induction | | | | 300° C.-2 sec | 500° C.-2sec |

DC: Direct current
PRC: Pulse Reverse Current

The resulting properties of the deposits obtained from the electroplating baths in table 1 are shown in table 2.

TABLE 2

| | Reference example | Example 1 | Example 2 | Example 3 | Example 4 |
|---|---|---|---|---|---|
| Thickness (μm) | 130 μm | 130 μm | 130 μm | 130 μm | 130 μm |
| Hardness (HV) | 1000-1200 | 750-800 | 800-900 | 1100-1200 | 1900-2100 |
| Adherence by Chiselling UNI EN ISO 2819 | Excellent | Poor | Good | Excellent | Excellent |
| Cathodic efficiency | 25-30% | 12-15% on Cr(III) | 12-15% on Cr(III) | 12-15% on Cr(III) | 12-15% on Cr(III) |
| Crystallinity | Crystalline | Amorphous | Amorphous | Crystalline | Crystalline |
| Chemical composition (by XPS) | Cr >99 | Cr = 92.5-95% w<br>C = 2-3% w<br>O = 3-4% w<br>N = 0.1-0.5% w | Cr = 92.5-95% w<br>C = 2-3% w<br>O = 3-4% w<br>N = 0.1-0.5% w | Cr = 92.5-95% w<br>C = 2-3% w<br>O = 3-4% w<br>N = 0.1-0.5% w | Cr = 92.5-95% w<br>C = 2-3% w<br>O = 3-4% w<br>N = 0.1-0.5% w |

The invention claimed is:

1. An electroplating bath for depositing chromium metal coating on a substrate or chromium metal alloy coating on a substrate consisting essentially of:

(a) 50 to 400 g/L (0.164 M to 1.314 M) of at least one trivalent chromium salt, (b) 100 to 400 g/L (2.17 M to 8.68 M) of at least one complexing agent, (c) 5 to 50 g/L(0.0425 M to 0.425 M) of at least one halogen salt, (d) 0.5 to 10 g/L of additives, wherein the additives comprise a quaternary ammonium compound, (e) 70 to 110 g/L of ammonia, and (f) optionally an alloy former, wherein the electroplating bath has a pH from 4 to 7 and is substantially free of divalent sulphur compounds and boric acid, its salts and/or derivatives and wherein the molar ratio of the complexing agent to the trivalent chromium salt is from 10:1 to 15:1, wherein the electroplating bath is substantially free of aluminium ions; and wherein the at least one complexing agent is selected from the group consisting of carboxylic acids and carboxylate salts, whereby, when the substrate is immersed in the electroplating bath and an electrical current is applied, the substrate is deposited with a chromium metal coating or a chromium metal alloy coating.

2. The electroplating bath of claim 1, wherein the trivalent chromium salt is selected from the group consisting of chromium(III) sulphate, in acidic or alkaline form, chromium(III) chloride, chromium(III) acetate, chromium(III) hydroxy acetate, chromium(III) formate, chromium(III) hydroxy formate, chromium(III) carbonate, chromium(III) methanesulfonate, potassium chromium(III) sulphate, and mixtures thereof.

3. The electroplating bath of claim 1, wherein the trivalent chromium salt is present in an amount of 100 to 300 g/L (0.328 M to 0.984 M).

4. The electroplating bath of claim 1, wherein the trivalent chromium salt is present in an amount of 120 to 160 g/L (0.3936 M to 0.5248 M).

5. The electroplating bath of claim 1, wherein the anion of the trivalent chromium salt is the anion of a volatile or electrochemically consumable acid.

6. The electroplating bath of claim 1, wherein the alloy former is present in the electroplating bath and is selected from the group consisting of vanadium, manganese, iron, cobalt, nickel, molybdenum, tungsten, and mixtures thereof.

7. The electroplating bath of claim 1, wherein the electroplating bath further comprises carbon, oxygen, and nitrogen provided from organic components or the ammonia in the electroplating bath.

8. The electroplating bath of claim 1, wherein the complexing agent is present in an amount of 100 to 300 g/L (2.17 M to 6.61 M) and/or the molar ratio of the complexing agent to the trivalent chromium salt is from 10:1 to 13:1.

9. The electroplating bath of claim 1, wherein the halogen salt is selected from the group consisting of bromide, chloride, iodide, and fluoride salts.

10. The electroplating bath of claim 1, wherein the electroplating bath is substantially free of chloride ions.

11. The electroplating bath of claim 1, wherein the at least one carboxylic acid or carboxylate salt is present as the sole at least one complexing agent in the electroplating bath.

12. The electroplating bath of claim 1, wherein the electroplating bath has a pH from 5.0 to 5.5.

13. A process for depositing chromium on a substrate including the following steps:

providing the electroplating bath of claim 1, providing an anode, immersing a substrate in the electroplating bath, and applying an electrical current to deposit a trivalent chromium metal coating or a chromium metal alloy coating on the substrate.

14. The process of claim 13, wherein the electroplating bath is separated from the anode by a membrane.

15. The process of claim 14, wherein an anolyte of the electroplating bath comprises chromium(III) sulphate.

16. The process according to claim 13, wherein trivalent chromium is deposited at a thickness within a range of 10 to 400 μm.

17. The process according to claim 13, wherein the electrical current applied is direct current.

18. The process according to claim 13, wherein the electrical current applied is pulsed current.

19. An electroplating bath for depositing chromium metal coating on a substrate or chromium metal alloy coating on a substrate consisting essentially of:

(a) 50 to 400 g/L (0.164 M to 1.314 M) of at least one trivalent chromium salt, (b) 100 to 400 g/L (2.17 M to 8.68 M) of at least one complexing agent, wherein the at least one complexing agent is selected from the group consisting of carboxylic acids and carboxylate salts and wherein the at least one carboxylic acid or carboxylate salt is present as the sole at least one complexing agent in the electroplating bath, (c) 5 to 50 g/L (0.0425 M to 0.425 M) of at least one halogen salt, (d) 70 to 110 g/L of ammonia;

(e) 0.5 to 10 g/L of additives, wherein the additives comprise a quaternary ammonium compound, and (f) optionally an alloy former, wherein the electroplating bath has a pH from 4 to 7 and is substantially free of divalent sulphur compounds and boric acid, its salts and/or derivatives and wherein the molar ratio of the complexing agent to the trivalent chromium salt is from 10:1 to 15:1, wherein the electroplating bath is substantially free of aluminium ions and is substantially free of chloride ions;

whereby, when the substrate is immersed in the electroplating bath and an electrical current is applied, the substrate is deposited with a chromium metal coating or a chromium metal alloy coating.

20. The electroplating bath of claim 19, wherein the electroplating bath has a pH from 5.0 to 5.5.

21. An electroplating bath for depositing chromium metal coating on a substrate or chromium metal alloy coating on a substrate consisting of:

(a) 50 to 400 g/L (0.164 M to 1.314 M) of at least one trivalent chromium salt, (b) 100 to 400 g/L (2.17 M to 8.68 M) of at least one complexing agent, (c) 5 to 50 g/L (0.0425 M to 0.425 M) of at least one halogen salt, and (d) 0.5 to 10 g/L of additives, wherein the additives comprise a quaternary ammonium compound, and (e) 70 to 110 g/L of ammonia, wherein the electroplating bath has a pH from 4 to 7;

wherein the molar ratio of the complexing agent to the trivalent chromium salt is from 10:1 to 15:1, wherein the at least one complexing agent is selected from the group consisting of carboxylic acids and carboxylate salts, whereby, when the substrate is immersed in the electroplating bath and an electrical current is applied, the substrate is deposited with a chromium metal coating or a chromium metal alloy coating.

* * * * *